US007475650B2

(12) United States Patent
Ruinen et al.

(10) Patent No.: US 7,475,650 B2
(45) Date of Patent: Jan. 13, 2009

(54) DEVICE FOR AN ANCHOR WITH A RETRIEVAL PROVISION

(75) Inventors: Roderick Michael Ruinen, AC Krimpen a/d Ijssel (NL); David Peter Van Den Ende, AC Krimpen a/d Ijssel (NL)

(73) Assignee: Rijhof Ankers Beheer B.V., Ijssel (NL)

( * ) Notice: Subject to any disclaimer, the term of this patent is extended or adjusted under 35 U.S.C. 154(b) by 0 days.

(21) Appl. No.: 11/792,549

(22) PCT Filed: Dec. 7, 2005

(86) PCT No.: PCT/NL2005/000841

§ 371 (c)(1),
(2), (4) Date: Jun. 7, 2007

(87) PCT Pub. No.: WO2006/062397

PCT Pub. Date: Jun. 15, 2006

(65) Prior Publication Data

US 2007/0261628 A1 Nov. 15, 2007

(30) Foreign Application Priority Data

Dec. 7, 2004 (NL) ..... 1027677

(51) Int. Cl.
*B63B 21/46* (2006.01)
*B63B 21/32* (2006.01)

(52) U.S. Cl. ..... 114/299; 114/301

(58) Field of Classification Search ..... 114/299
See application file for complete search history.

(56) References Cited

U.S. PATENT DOCUMENTS

| | | | | |
|---|---|---|---|---|
| 3,450,088 | A * | 6/1969 | Guier | 114/298 |
| 4,987,847 | A * | 1/1991 | Kobayashi | 114/297 |
| 5,074,235 | A * | 12/1991 | Kobayashi | 114/299 |
| 5,546,884 | A | 8/1996 | Van Den Haak | |
| 5,640,921 | A * | 6/1997 | Van Den Haak et al. | 114/301 |
| 5,901,990 | A | 5/1999 | McMillan | |
| 6,311,636 | B1 * | 11/2001 | Degenkamp | 114/297 |

FOREIGN PATENT DOCUMENTS

| | | |
|---|---|---|
| EP | 0 802 111 | 10/1997 |
| EP | 0 961 728 | 12/1999 |
| WO | 98/36963 | 9/1998 |
| WO | 00/50301 | 8/2000 |

* cited by examiner

*Primary Examiner*—Jesus D Sotelo
(74) *Attorney, Agent, or Firm*—Ladas & Parry LLP

(57) ABSTRACT

Device for connecting an anchor line to an anchor, which anchor has a fluke and according to a direction of penetration can penetrate into an anchoring ground by exerting a tensile force on the anchor line, wherein the device is provided with an attachment means for attachment of an anchor line to the device and at least two attachment means for attachment of two fluke-anchor line connection elements which at locations that are spaced apart in a forward direction of penetration are attached to the fluke, wherein at least one of the attachment means is adapted for release by swinging the anchor line with respect to the device.

25 Claims, 18 Drawing Sheets

DEVICE FOR AN ANCHOR WITH A RETRIEVAL PROVISION

The invention relates to a device for an anchor with retrieval provision. The invention furthermore relates to a detachable connection between connection elements of an anchor and an anchor line. The invention furthermore relates to a method for retrieving an anchor.

It is known to retrieve anchors after they have served their purpose in an anchoring ground, from said ground. An old example of an anchor intended for that purpose is shown in Japanese patent application 58.178075. Said anchor has a cable running parallel to the shank, which cable at its lower end is connected to the rear side of the fluke and at the upper end is connected to a hook that can be unfolded and usually extends into a ring at the upper end of the shank. By swinging the anchor line the movable part of the hook is released and the cable becomes detached at that location and a tensile force in the anchor line will be transferred via the cable to the rear side of the fluke which as a result can be pulled in.

Another example is shown in U.S. Pat. No. 3,450,088, in which a shank forms the connection between the anchor line and the fluke, and is connected halfway to the fluke via an inclined forwardly extending elongated rigid plate. The plate is connected to the shank by means of a breaking connection. By swinging the anchor line rearward the connection is broken and the shank is released from the plate, so that the shank is able to swing rearward and the point of engagement of the force exerted by the anchor line is exerted on the rear side of the fluke, so that the anchor can be pulled in.

A more recent example is shown in European patent 0.961.728, in which an anchor provided with a connection between fluke and anchor line that consists of wires is described, wherein the front shank wires are attached tot he fluke by means of a detachable hook connection. By swinging the anchor line the hooks are released and the anchor can be pulled in due to pull on the anchor line transferred to the fluke via the rear connection wires.

SUMMARY OF THE INVENTION

It is an object of the invention to provide a coupling/connection device of the type mentioned in the preamble, for anchors having fluke-anchor line connections that consist of several connection elements, which can be compact and is able to work reliably.

From one aspect the invention provides a device for connecting an anchor line to an anchor, which anchor has a fluke and according to a direction of penetration can penetrate into an anchoring ground by exerting a tensile force on the anchor line, wherein the device is provided with an attachment means for attachment of an anchor line to the device and at least two attachment means for attachment of two fluke-anchor line connection elements which at locations that are spaced apart in direction of penetration are attached to the fluke, wherein at least one of the attachment means is adapted for release by swinging the anchor line with respect to the device.

The release provision in such anchors can thus be arranged in a part that has to be present anyway, namely the coupling/connection device for the fluke-anchor line connection elements and the anchor line. The release provision then remains spaced apart from the fluke and the forces occurring there.

In one embodiment the at least one attachment means is adapted for release by swinging the anchor line in a plane containing the direction of penetration and the two attachment means, particularly by (with respect to the direction of penetration) rearward swinging of the anchor line.

If the at least one attachment means is adapted for release of the, considered in direction of penetration, front fluke-anchor line connection elements, the pull-in force will be transferred to the rear end of the fluke.

In one embodiment the at least one attachment means by said swinging of the anchor line is movable between a first position in which the said fluke-anchor line connection element is attached to the device and a second position in which the said fluke-anchor line connection element can be released from the device. The at least one attachment means may comprise a confinement member which is movable from the first to the second position by rotation with respect to the device in response to the swinging of the anchor line. In that case the confinement member may comprise a hook, which in the attaching condition engages about the upper end of the fluke-anchor line connection elements in question and is rotatably arranged on the device, in response to the swinging of the anchor line. In one embodiment the device is provided with means for keeping the confinement member hook in the second position, so that the release cannot be hindered by the confinement member moving back.

In a further embodiment the device is provided with first and second attachment means for front and rear fluke-anchor line connection elements, respectively, which first and second attachment means are spaced apart, wherein, considered in side view, the device with the fluke-anchor line connection elements and the fluke forms a quadrangle with four corner hinges.

In a manner known from the above-mentioned European patent specification the device, for during installation altering the angle between the fluke-anchor line connection and fluke, can be provided with, in one embodiment remote controlled means for altering the relative position of the first and second attachment means, particularly by rotation of the device in a plane perpendicular to the fluke and containing the direction of penetration. In that way the device can also be adapted as an angle adjuster of the angle between the assembly of fluke-anchor line connection elements and the fluke, and comprise a first part and a second part, which have been provided with the connection means for the anchor line and the first and/or the second attachment means, respectively, wherein the first and the second part are connected to each other by means of a hinge and a spaced apart releasable connection, which releasable connection is adapted for failure when exceeding a certain tensile force in the anchor line for allowing the first part and second part to rotate away from each other. In this case the provisions for both the release function and the angle altering option are present in the coupling/connection device.

In one embodiment the second part comprises at least the first attachment means and the hinge is situated rearward from the releasable connection. The angle adjuster can be adapted for after release, by increasing the mutual angle between the first and the second part adjusting the angle between the assembly of fluke-anchor line connection elements and the fluke to a first angle of almost 90 degrees (normal or near-normal load).

In one embodiment the releasable connection is adapted for release by swinging of the anchor line, and in one embodiment adapted for release by rearward swinging of the anchor. The second angle necessary for release of at least one of the said attachment means may extend beyond the first angle, so that the operation areas may not undesirably coincide. This is further prevented if the second angle is situated at 5 degrees or more, in one embodiment at 20 degrees or more beyond the first angle. The device may be adapted for after further increase of the mutual angle between the first and the second part releasing the said attachment means. The device may then be adapted for releasing the said attachment means not until an intermediate angle between the first and the second part has been further passed through. The intermediate angle may be 5 degrees or more, in one embodiment 20 degrees or more.

In a simple reliably operating embodiment the first part and the second part are provided with a cam track and an operation means controlled by the cam track, respectively, for the release of the at least one attachment means. In an alternative embodiment the first part can be provided with a stop, and the second part can be provided with a cam, which is part of a movement mechanism for a confinement member for the at least one attachment means. The cam can be rotatable about the hinge between the first and the second part, as a result of which the structure can be kept simple an failure-proof.

The cam can be part of a member movable by the stop, which member by means of a movable connection, such as a rod hinging at both ends, is connected to the confinement member.

In order to prevent premature release a breaking connection, such as a breaking pin, can be arranged between the cam or the member of which the cam is part and the second part, which breaking connection will not fail until at a desired force and then release the release mechanism.

From a further aspect the invention provides an anchor provided with a coupling/connection device according to the invention.

From a further aspect the invention provides a method for retrieving an anchor pulled in an anchoring ground, which anchor has a fluke having a longitudinal axis and a fluke-anchor line connection composed of fluke-anchor line connection elements, as well as a coupling/connection device according to the invention situated at the upper end of the fluke-anchor line connection, wherein the fluke-anchor line connection elements at their lower ends are attached to the fluke at locations spaced apart in longitudinal axis direction, for retrieving the anchor the at least one connection means is released and the anchor by pull at the anchor line with coupling/connection device, fluke-anchor line connection elements and fluke is pulled out of the anchoring ground.

From a further aspect the invention provides in such a method, while using a coupling/connection device according to the invention with which said fluke-anchor line connection-fluke angle can be altered, wherein the anchor line during penetration/installation of the anchor in the anchoring floor is held at an initial angle to the longitudinal axis of the fluke, after or near completion of the penetration is swung rearward over a first angle in order to bring the anchor line substantially perpendicular to the longitudinal axis, wherein the first and second parts rotate with respect to each other, in order to complete the installation, wherein, at the end of the stage of use of the anchor, for retrieving the anchor, the anchor line is swung further, beyond the first angle, in order to, in one embodiment not until after passing through an intermediate angle, release the at least one attachment means.

The aspects and measures described and/or shown in the application may where possible also be used individually. Said individual aspects may be the subject of divisional patent applications related thereto.

BRIEF DESCRIPTION OF THE DRAWINGS

The invention will be elucidated on the basis of two exemplary embodiments shown in the attached drawings, in which.

DETAILED DESCRIPTION OF THE DRAWINGS

Figure 1:
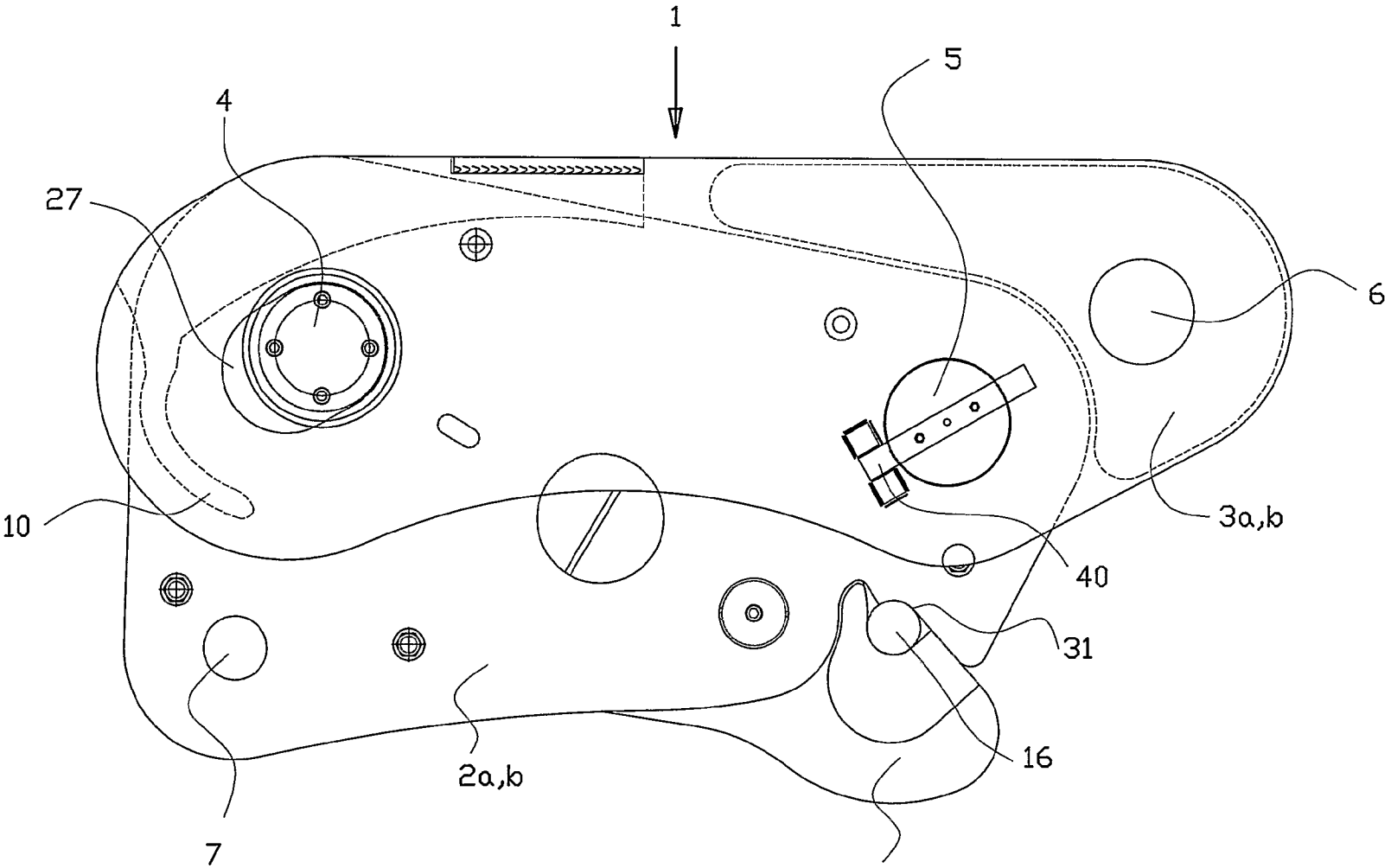
FIG. 1 shows a side view of an exemplary embodiment of a coupling/connection device according to the invention.

The coupling/connection device 1 in FIG. 1 comprises a number of plates 2 and 3, particularly two centre plates 2*a,b* and two outer plates 3*a,b*, which are situated on either side of the centre plates 2*a,b*. The plates 2 and 3, in the condition shown in FIG. 1, are fixedly connected to each other at the location of a hinge pin 4 and a pin 5. The pin 5 is provided with a breaking member 40. Where the plates 3*a,b* extend beyond the centre plates 2*a,b*, said plates are provided with a hole 6, for stationary (optionally movable to a limited extent in an elongated hole), rotatable attachment of an anchor line that is not shown here. The coupling/connection device 1 is designed and suitable for at the location of the hole 6 absorbing large tensile forces in the anchor line, and transferring them to fluke-anchor line connection elements and via them to an anchor fluke for penetration of the anchor fluke in an anchoring ground. The plates 3*a* are each provided with a slotted hole 27, in which the hinge pin 4 is slidable.

The centre plates 2*a,b* that are kept slightly spaced apart, near one vertex are provided with a hole 7 for attachment of a fluke-anchor line connection element that is not shown here of an anchor that is not shown. The fluke-anchor line connection element may for instance be a chain, wire or cable.

Figure 2:
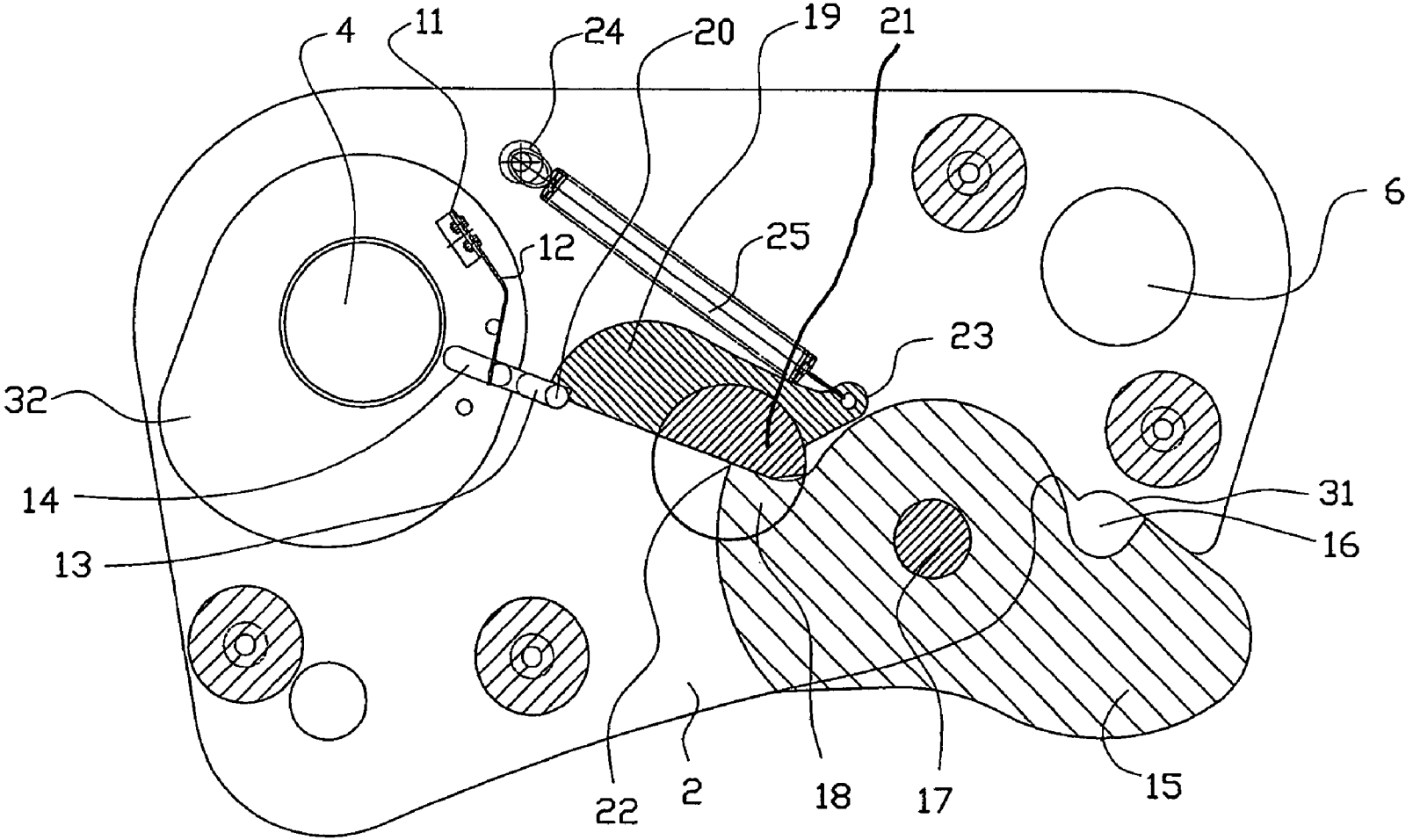
FIGS. 2 and 3 show a first plate part and a second plate part, respectively, of the device of FIG. 1.

At the opposite corner a hook 15, further shown in FIG. 2, is arranged between the centre plates 2*a,b*. At the location of hinge pin 17 the hook 15 is rotatably attached to the plates 2*a,b*. The rotatable hook 15 is provided with a hook opening 16 that opens in the direction of hole 6 for the anchor line that is not shown and with the edge 31 forms an accommodation space for an upper end of the fluke-anchor line connection element.

Figure 3:
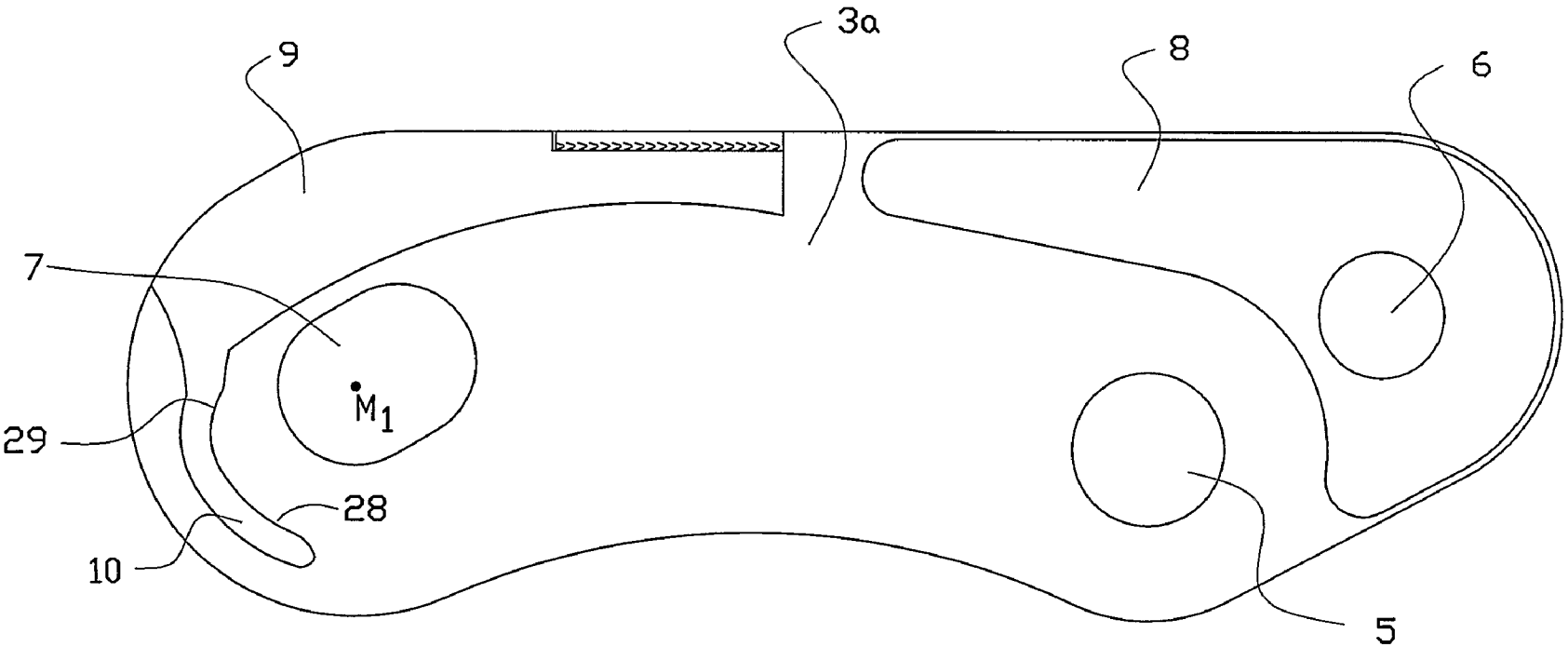

The outer plates 3*a,b* at the side facing the centre plates 2*a,b* are provided with elevations/reinforcements 8 and 9, wherein the elevation 9 merges into a finger 10. The finger 10 is bent and at the concave side has a with respect to M1 (FIG. 3) concentric edge 28, which changes into a more inwardly situated pilot edge 29.

A recess 30 is arranged in the centre plates 2*a,b*, in which recess at the location of 11*a* leaf spring 12 is attached. The end of the leaf spring 12 abuts a slide 13, that is reciprocally movable in straight guides 14 arranged in the plates 2*a,b*. The slide 13 is provided with a passage 13*a*, into which the finger 10 extends. The slide 13 engages into a recess 20 of a lever 19 which with integrally formed circle disk 19*a*, which is fittingly accommodated in holes 22 in plates 2*a,b*, is rotatably attached to the centre plates 2*a,b*. The other end of the lever 22 has an eye 23, in which an end of a tension spring 25 is attached, which tension spring 25 with its other end is fixedly attached at the location of 24 to the centre plates 2*a,b*. Near the point of rotation 22 the lever 19 is provided with a stop surface 21, which in the shown position of the FIG. 2 abuts a stop surface 18 on the hook 15, at the side of its point of rotation 17 opposite the hook opening 16.

Figure 4A:
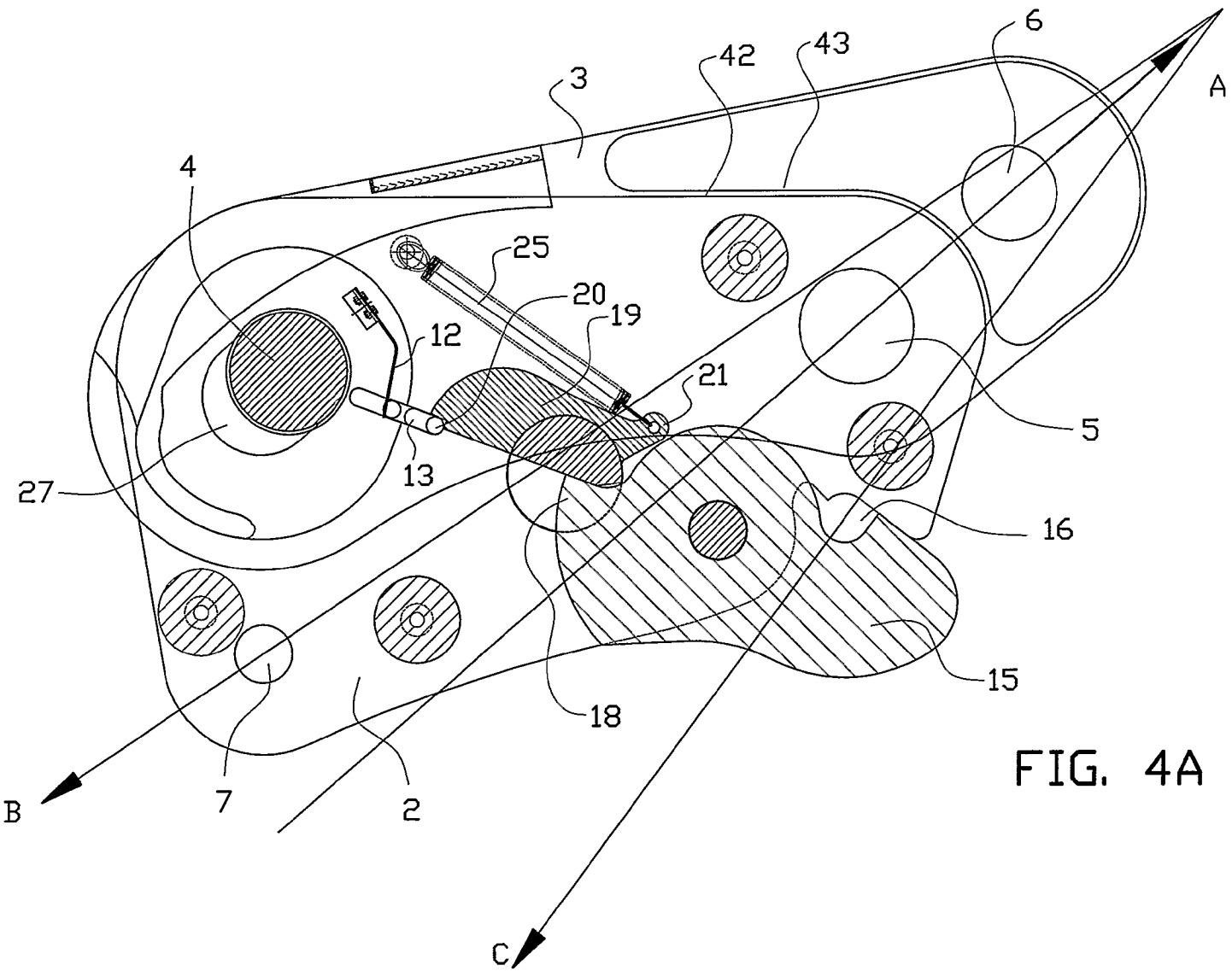
FIGS. 4A-C show three consecutive stages of use of the device of FIG. 1.
Figure 5A:
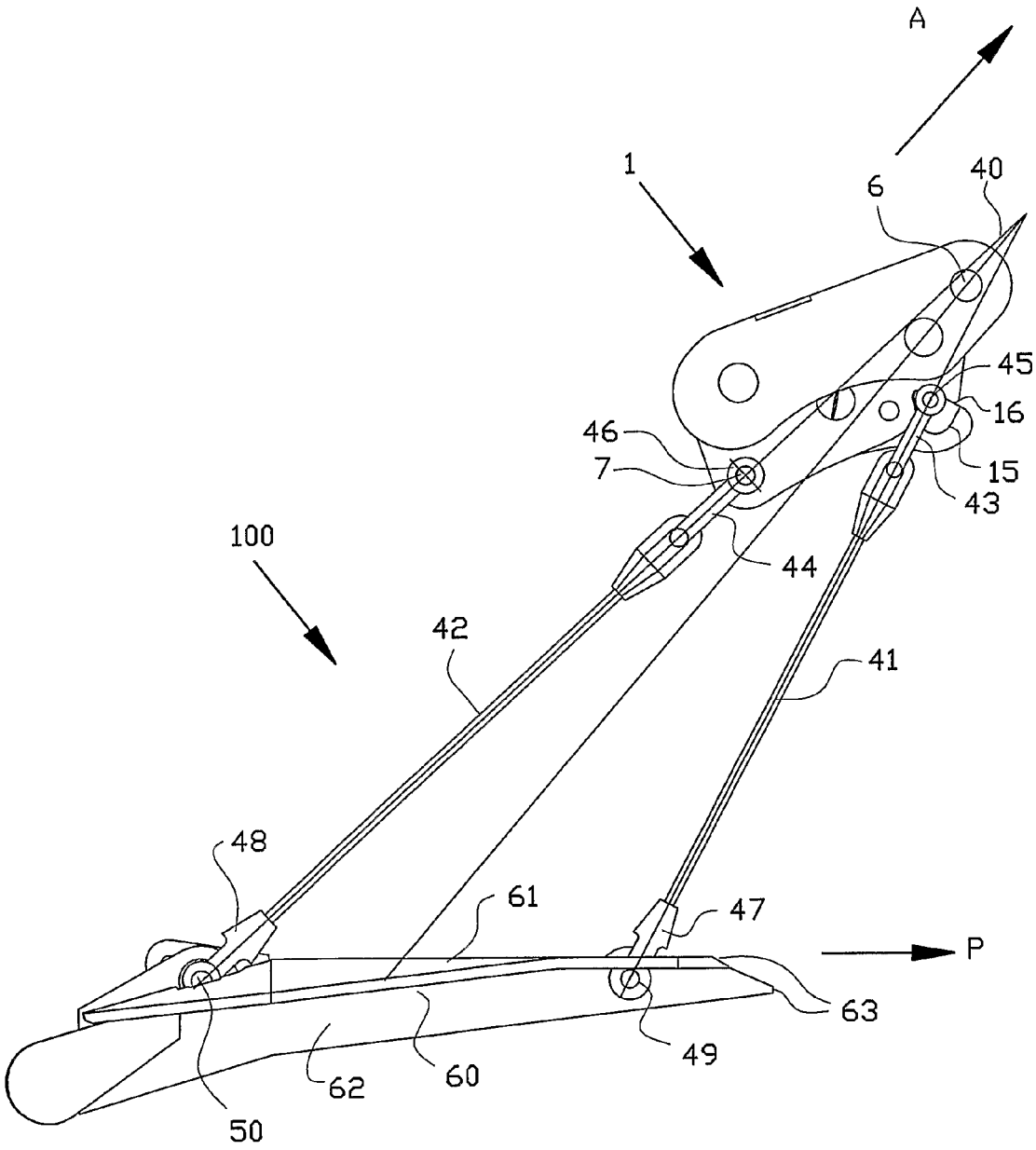
FIGS. 5A-E show five consecutive stages of use of an exemplary embodiment of an anchor according to the invention provided with a device according to FIG. 1.

In the condition shown in FIG. 4A the coupling/connection device 1 is in condition in which it is not unfolded. The device 1 is then in the situation shown in FIG. 5A, in which an anchor 100 is provided with the device 1 which at an anchor line 40 is attached in eye 6, wherein bow shackle pins 45, 46 have been arranged in hook opening 16 and hole 7, respectively, wherein the bow shackles 43, 44 form the attachment for flexible fluke-anchor line connection elements 41, 42 (usually pairs of wires or pairs of chains, that are spaced apart in the plane of the drawing), which fluke-anchor line connection elements 41, 42 at their lower ends 47, 48 at the location of hinges 49, 50 are attached to the fluke 60. The fluke 60 has an upper surface 61, a lower surface 62 and a front edge 63.

During pulling in an anchor 100 thus composed into an anchoring ground, the anchor line 40 is pulled in the direction A. As a result the fluke 60 will penetrate the anchoring ground in the direction P. This is the installation condition.

In the installation condition the interplay of forces is exerted on the coupling/connection device 1 as shown in FIG. 4A. The plates 2, 3 are fixedly connected to each other at the location of hinges 4 and 5.

Figure 4B:
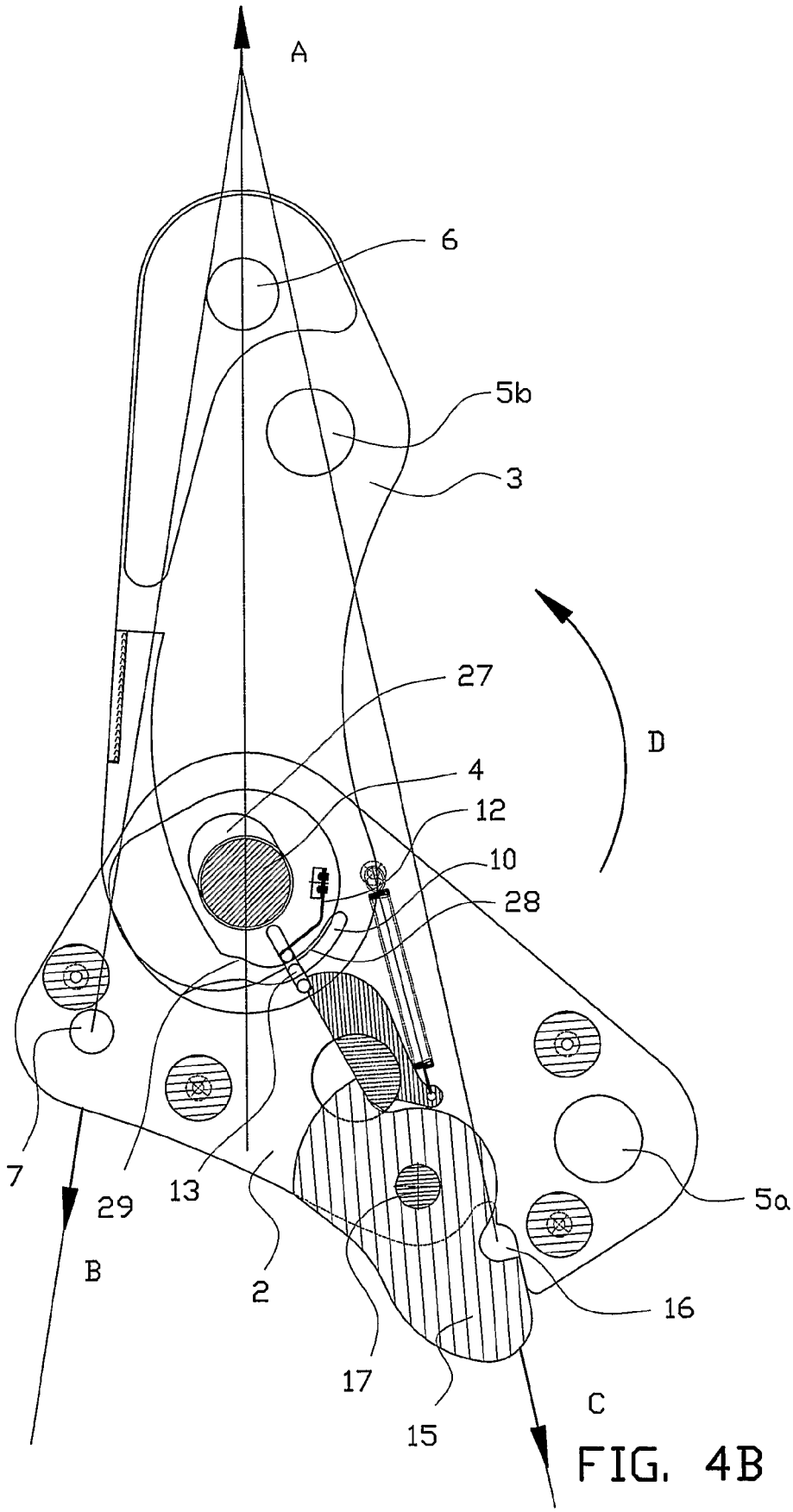
Figure 5B:
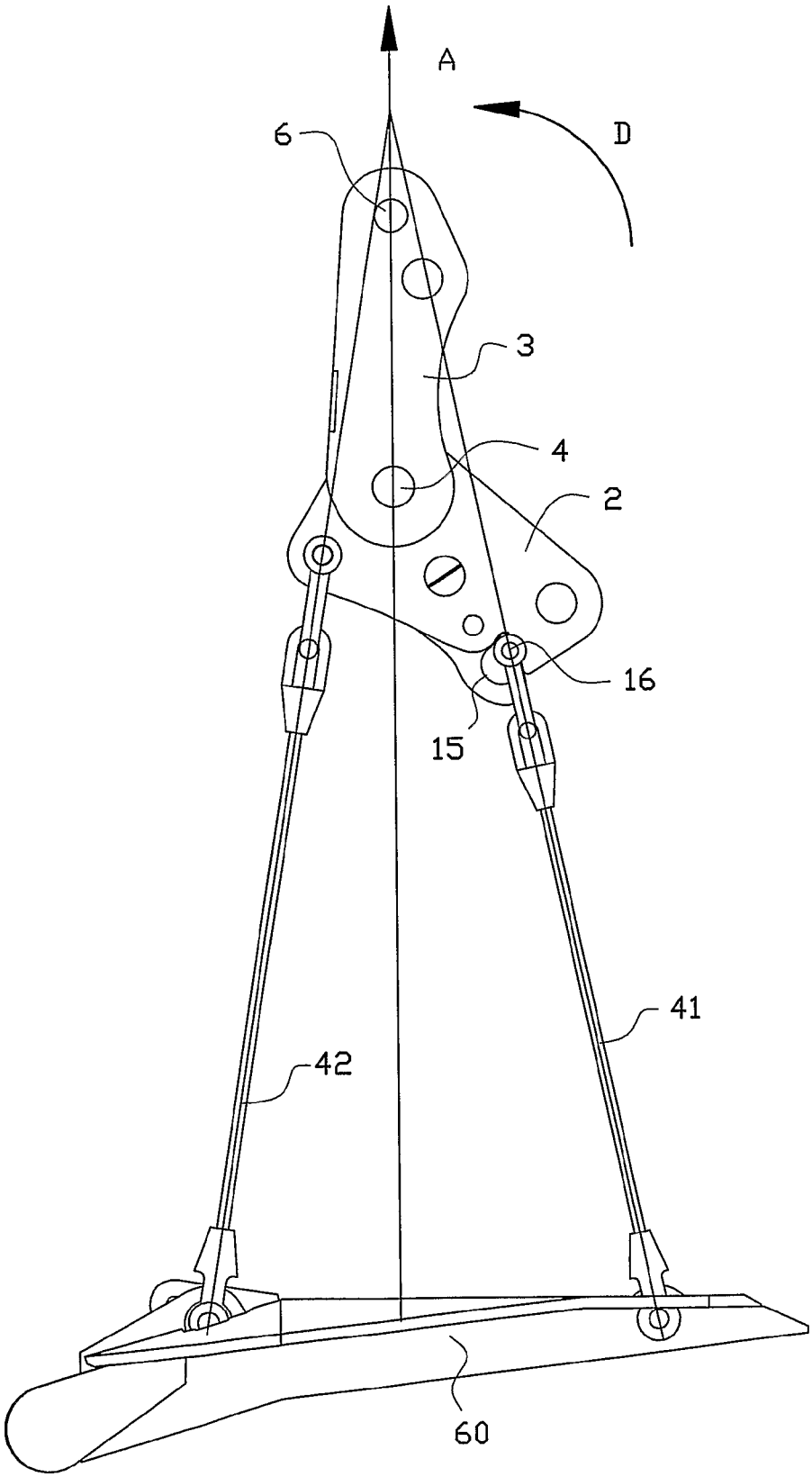

When the anchor 100, particularly the fluke 60, has penetrated sufficiently deep into the anchoring ground, it is desirable to increase the angle of the anchor line 40 with respect to the horizontal. For that purpose the anchor line is swung in the direction D. During said swinging a threshold value in the shearing force exerted on the breaking pin 40 at the location of the connection 5 will be exceeded, as a result of which the breaking pin 40 breaks and the connection 5 is broken, as a result of which the plates 2 and the plates 3 on the other hand are able to move apart. Said motion takes place about hinge 4, optionally with some translation in slotted hole 27. As the plates 2*a,b* have been swung at an angle exceeding 90°, the hinge 4 now contacts the other end of the slotted hole 27, as can also be seen in FIG. 4B. The fluke 60 will then move forward and downward, until the condition of FIG. 5B has been reached, in which the anchor line is perpendicular to the upper surface 61 of the fluke 60 and at the upper end can be attached to the object to be anchored. It is noted that for illustration the orientation of the fluke 60 in FIG. 5B is drawn similar to the one of FIG. 5A, it should be understood however that in relation to the anchoring ground the fluke 60 in FIG. 5B will be oriented inclined to the right and downward, and the direction A inclined to the right and upward.

When swinging the plates 3 with respect to the plates 2, the lip 10 is also rotated with respect to the guide 14, but the condition of the slide 13 has not changed yet. The slide 13 is still kept pressed in the recess 20 under the influence of the force of the spring 12, as a result of which the lever 19 is still locked in its place, and thus the hook 15 is stopped against rotation.

Figure 4C:
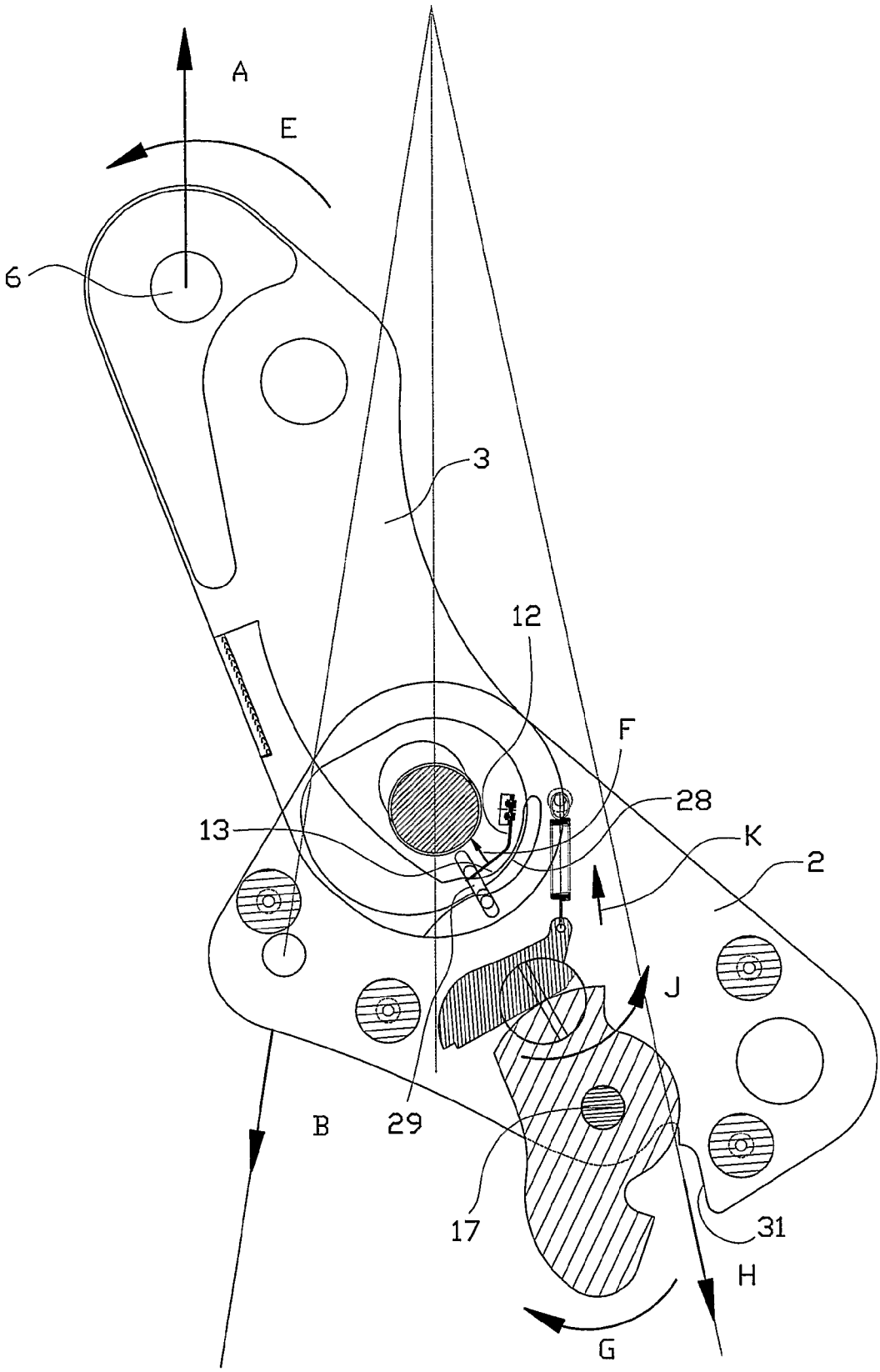
Figure 4D:
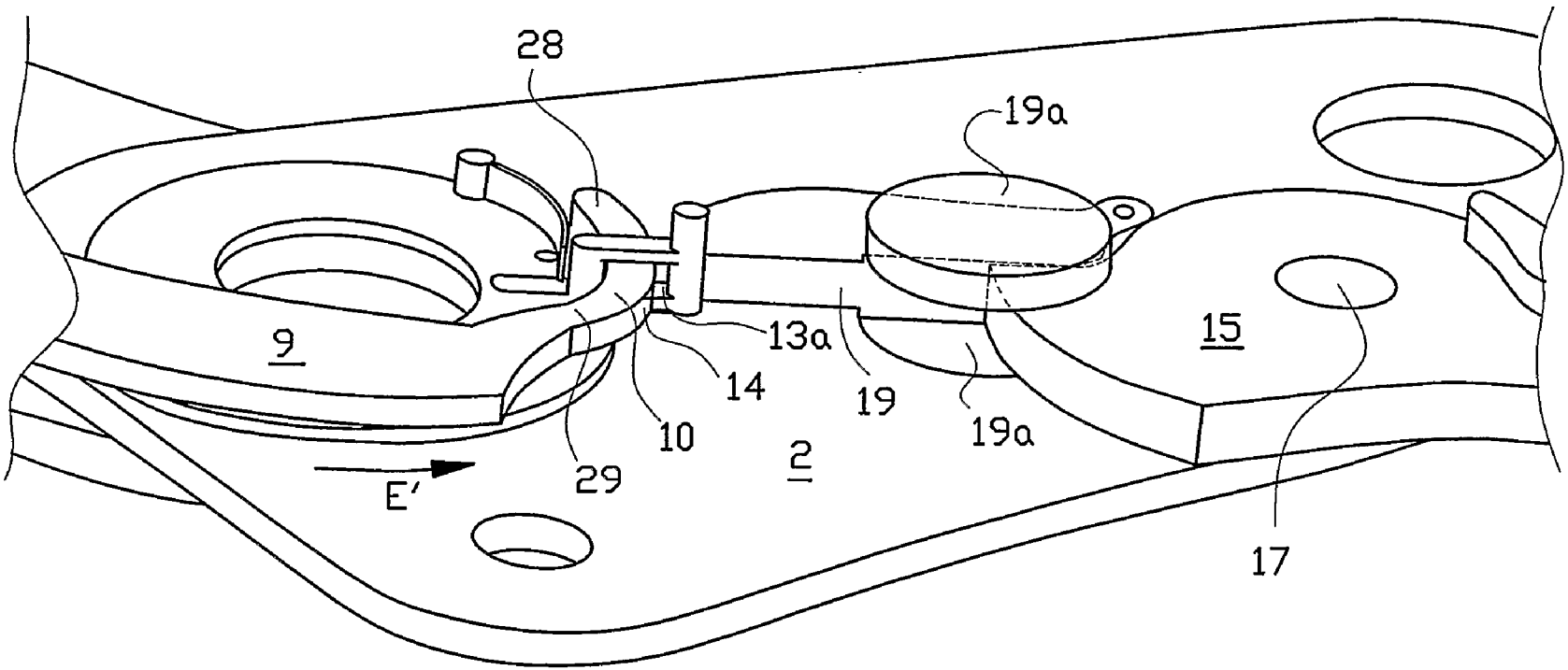
FIGS. 4D and 4E show a schematic view of the conditions of FIGS. 4B and 4C.
Figure 4E:
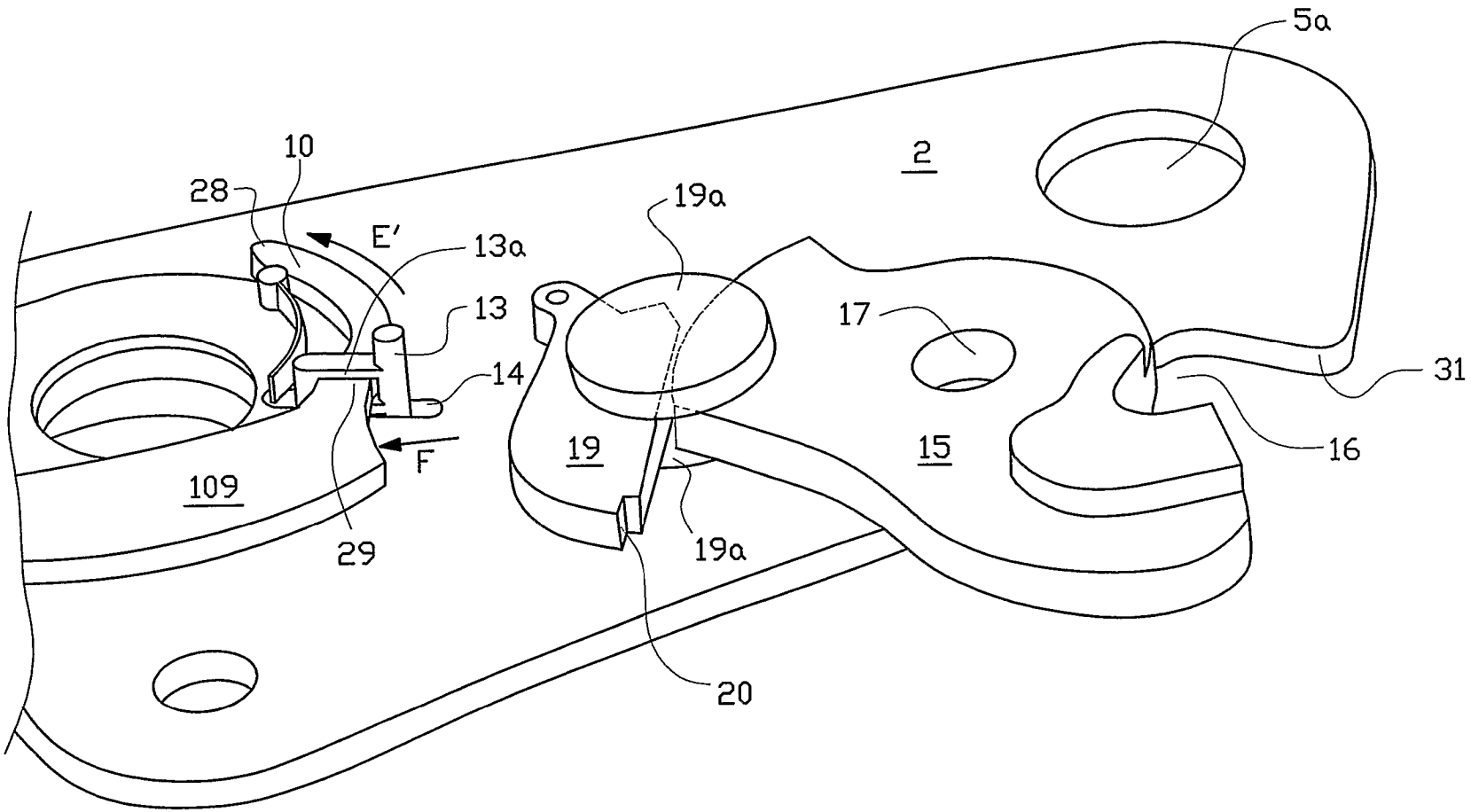
Figure 5C:
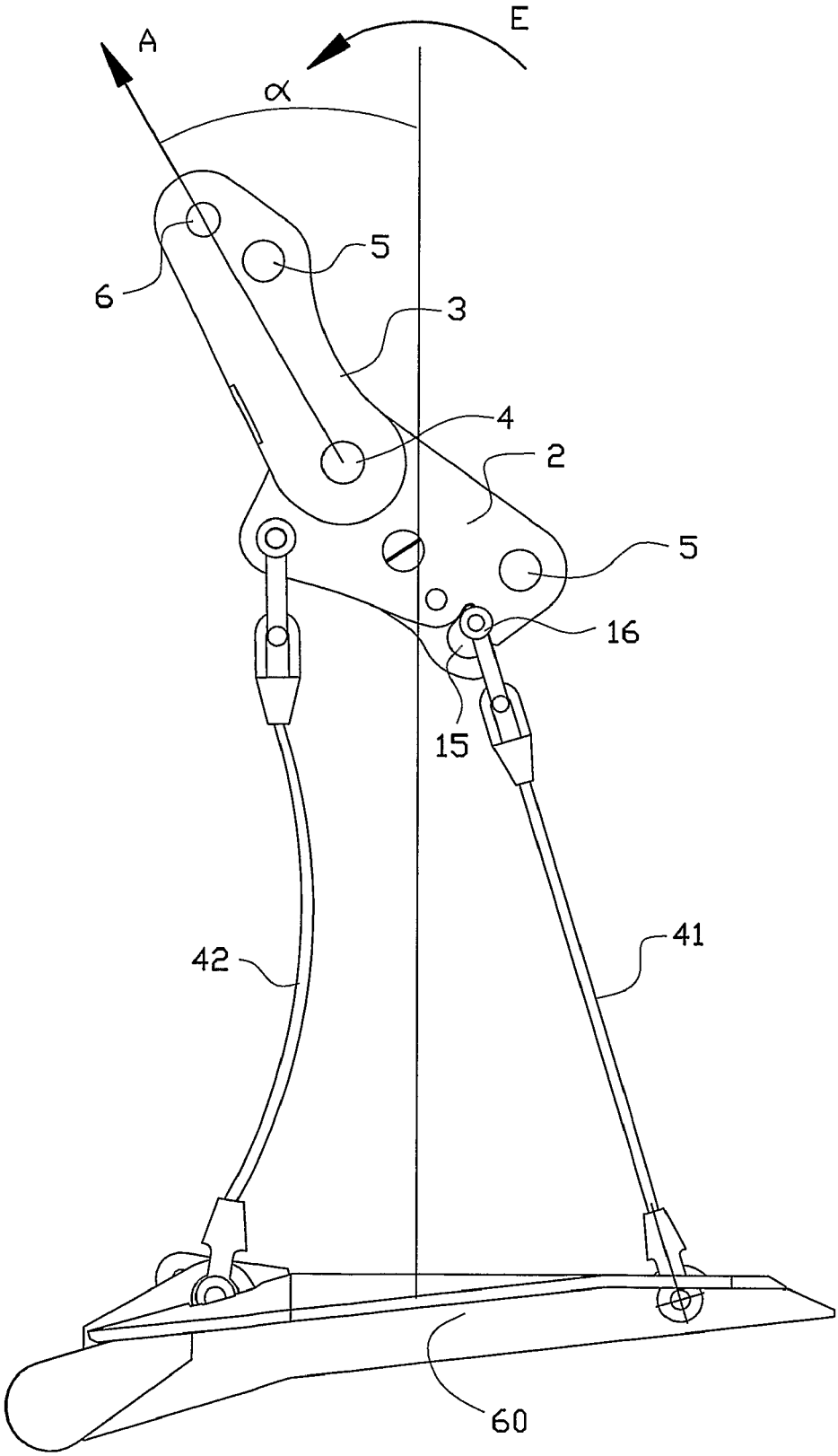

After the period of use, which may be many years, it may be desirable to pull in the anchor 100. For that purpose the anchor line 40 is swung further in the direction E, as can be seen in FIG. 5C. The swing angle a may be 25° here. As a result the plates 3*a,b* will rotate further with respect to the plates 2*a,b* and the slide 13 will contact the pilot edge 29 of the finger 10 (which moves relative in the direction E' in the passage 13*a* of the slide 13). The slide 13 will as a result be moved in the direction F towards hinge 4 (compare FIGS. 4D and 4E). In case of sufficient swinging, over for instance 5° (together for instance 30° (angle A, FIG. 5D)) the slide 13 will come out of engagement with the recess 20 and the tension spring 25 will become effective and retract (direction K) and the lever 19 rotate in the direction J about the point of rotation formed in hole 22. As a result thereof the stop surface 21 will be rotated out of the path of stop surface 18 of the hook 15, so that the hook 15 is able to rotate in the direction G about the hinge pin 17. This is indicated in FIG. 4C. As a result thereof the hook opening 16 is rotated away from the counter edge 31 on the plates 2*a,b* and the pin of the shackle 45 can move out of the hook opening 16. The hook 15 may optionally in a position shown in FIG. 4C be kept open by abutment against the rotated lever 19, so that the hook 15 remains properly open. Due to the ratios of the lengths/surfaces of the hook 15, the lever 19 and the slide 13 a large force on the hook 15 is converted into a small force on the slide 13, so that it will follow the movement of the edge 29 and the intended further swinging (direction E) of both parts 2, 3 is not hindered.

Figure 5D:
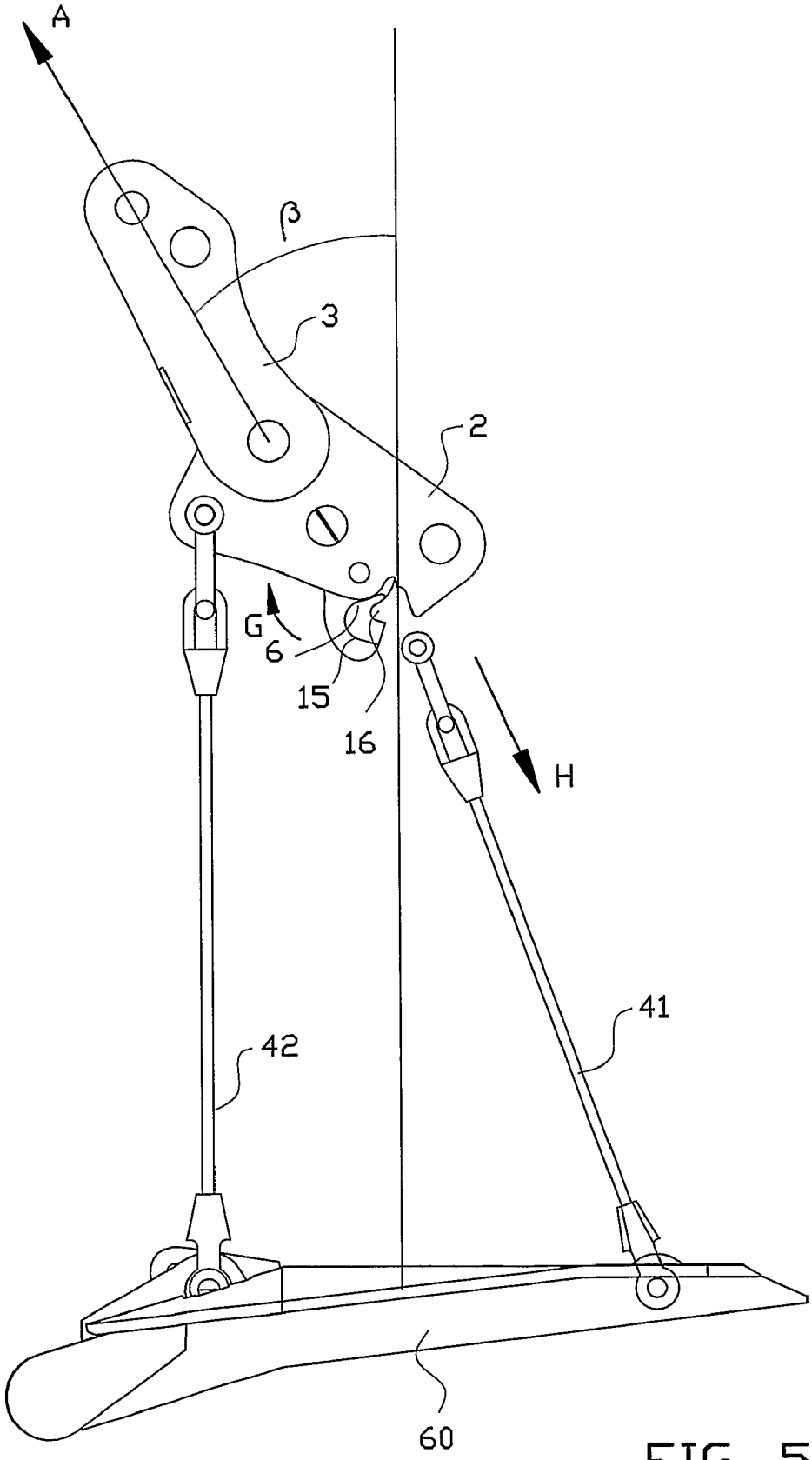
Figure 5E:
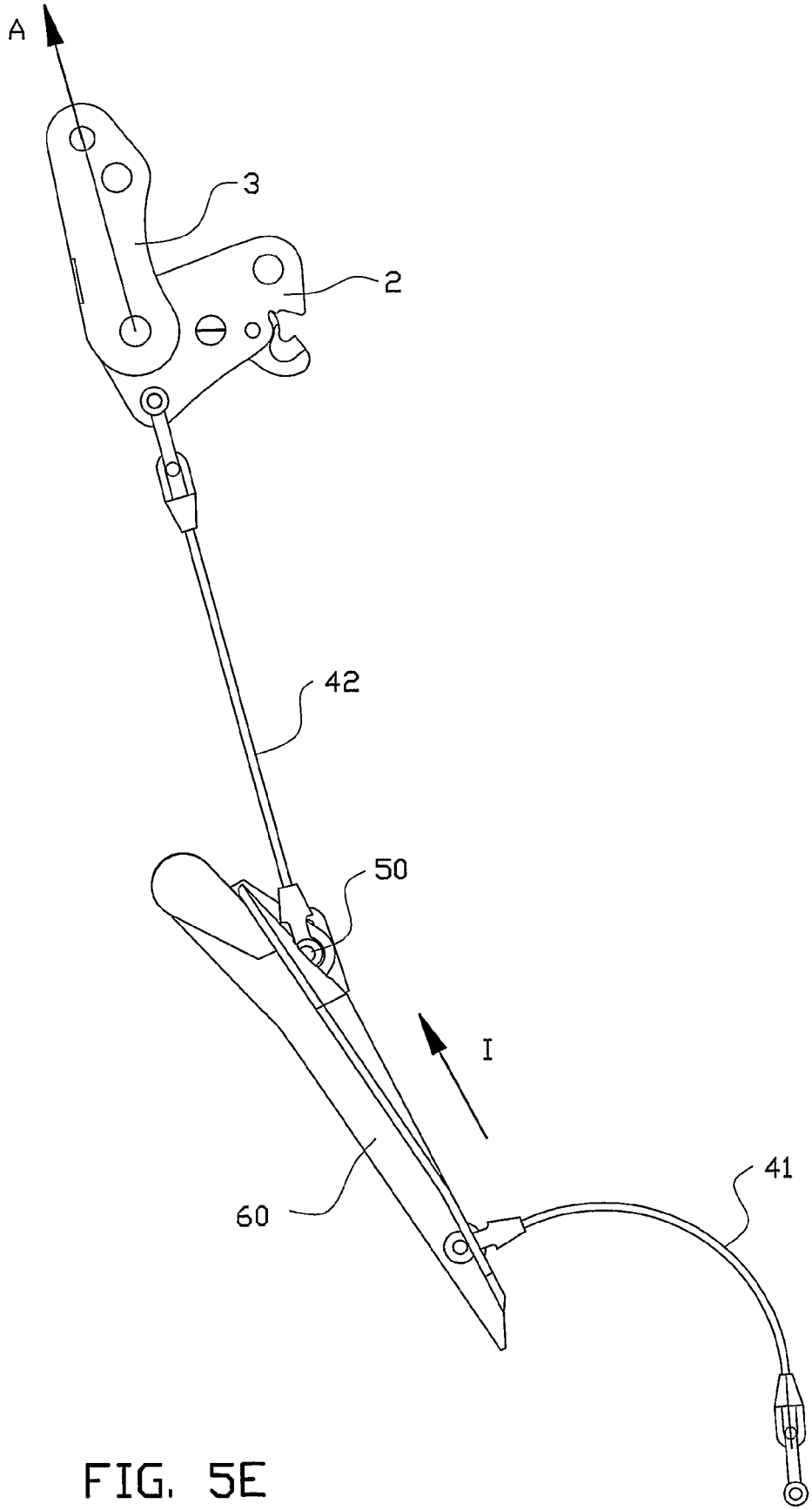

In that way the front wires 41, as can also be seen in FIG. 5D have been released from the coupling/connection device 1, and the coupling/connection device 1 merely forms a connection between the anchor line 40 and the rear fluke anchor line connection elements 42. By pulling in the anchor line 40 a force will be exerted on the fluke 60 only at the location of the connection point 50, which is situated at the rear of the fluke 60, as a result of which the fluke 60 will be oriented to the pulling-in direction of the anchor line A and be pulled out of the ground in the direction I.

An advantage of this manner of pulling in the anchor 100 is that all elements are taken along, including fluke-anchor line connection elements and coupling/connection device.

The connection device 101 in FIGS. 6A-D and FIG. 7 comprises an inner plate 102 and two outer plates 103*a,b*, which are situated on either side thereof and are fixedly connected to each other among others by means of edge 108. The plates 102 and 103*a,b* are hinged to each other at the location of hinge (pin) 107. The hinge 107 also serves as attachment for one or more rear wires, cables or chains that are connected to an anchor fluke that is not further shown. The centre plate 102 is provided with a rotatable, more or less hook-shaped confinement member 115, with which a pin 116 can be kept confined/held, which pin 116 forms the upper end of one or more wires, cables or chains that are not further shown which with their lower end are attached to a front area of the anchor fluke that is not shown. The confinement member 115 opens in rearward direction.

At the end of the plate 103*a,b* that faces away from the hinge 107 a hole 106 is provided, in which an attachment pin for an anchor line or penetration line that is not further shown can be accommodated for attaching an anchor line stationary (optionally moveable to a limited extent in a long hole) and rotatably to the device 101. The coupling/connection device 101 is designed and suitable for at the location of hole 106 absorbing the large tensile forces in the anchor line, and transferring them to fluke-anchor line connection elements and via them to an anchor fluke for penetration of the anchor fluke into an anchoring ground.

Figure 6A:
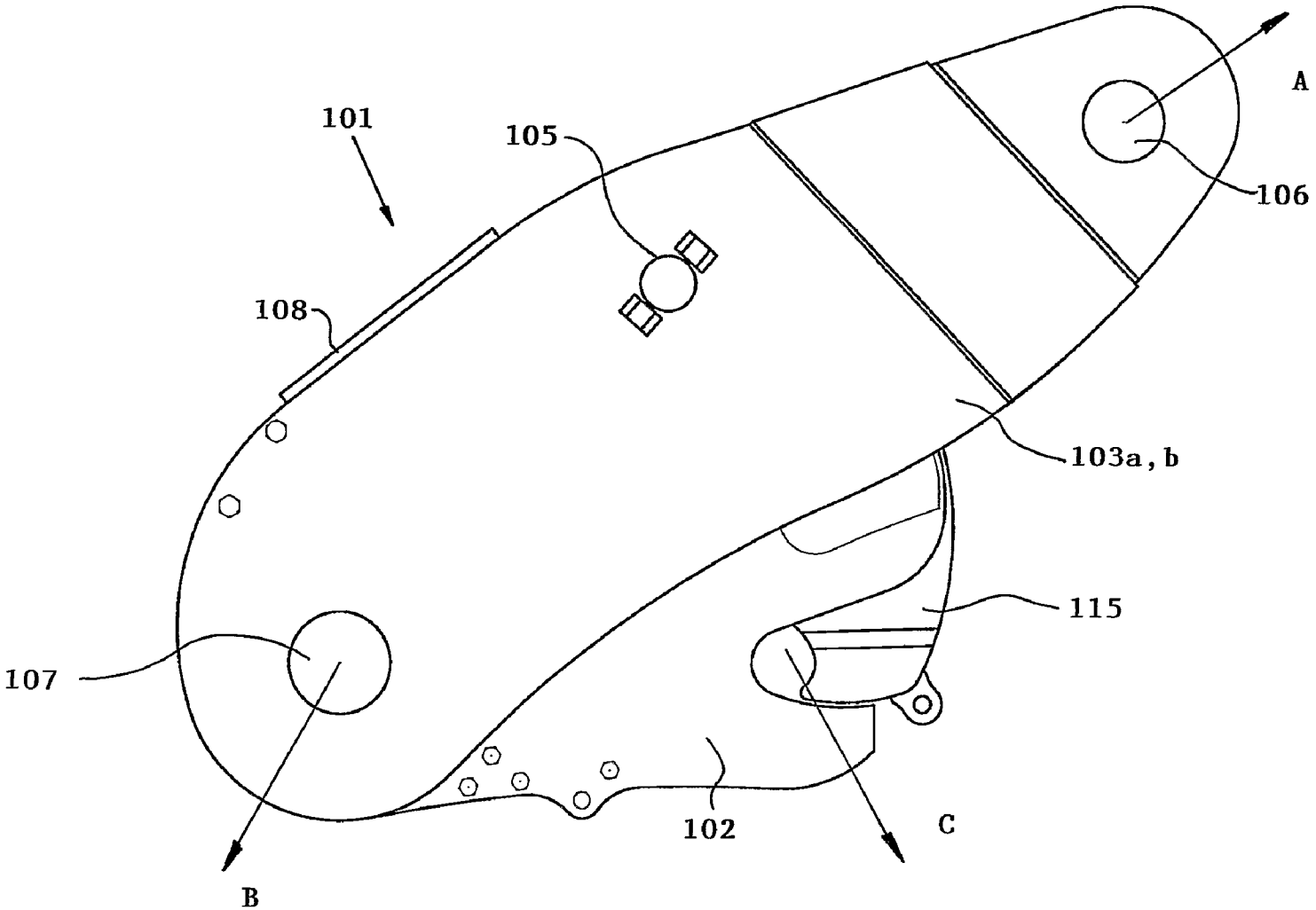
FIG. 6A shows a view of a second exemplary embodiment of a connection device according to the invention.
Figure 6B:
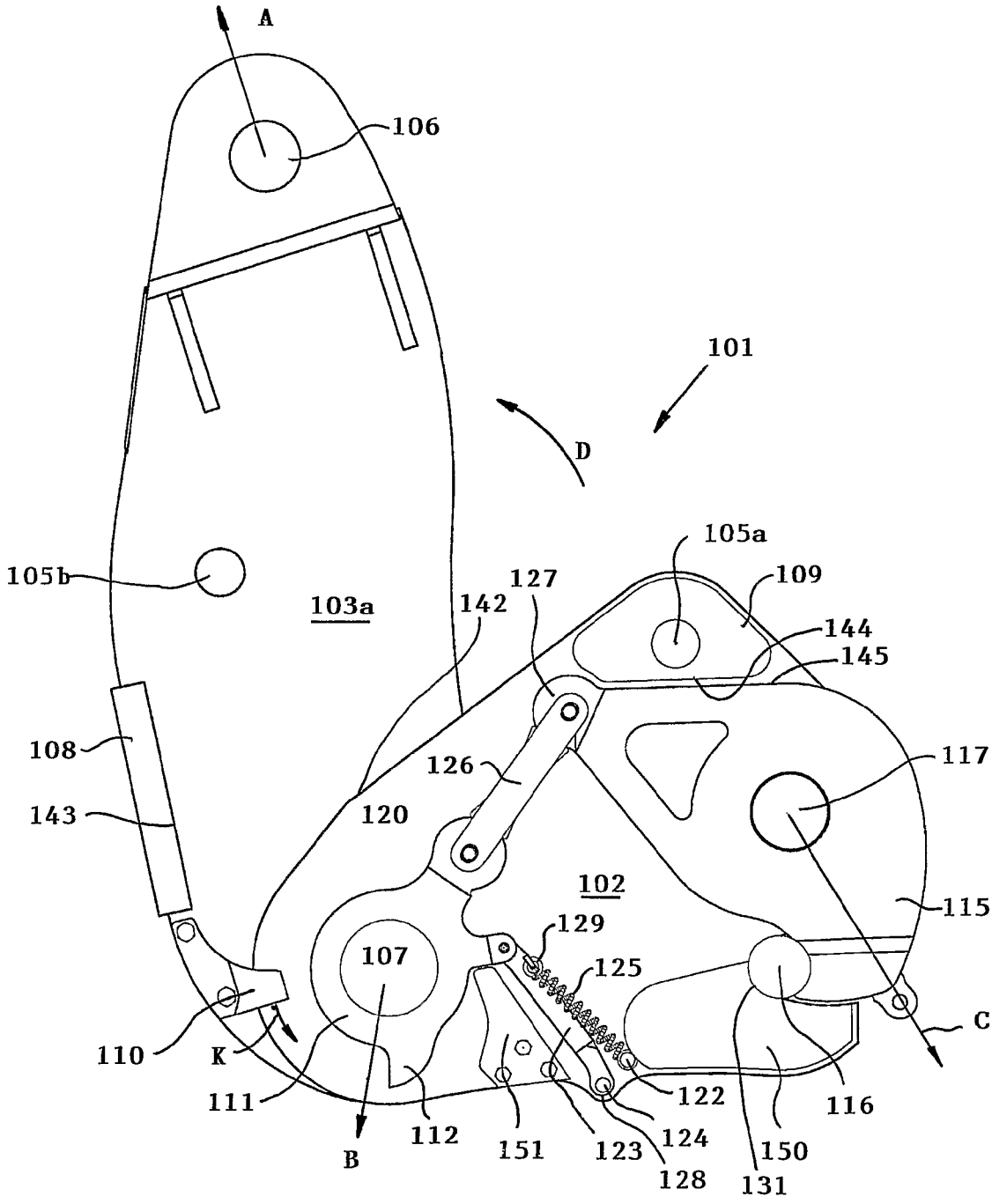
FIGS. 6B-D show three consecutive stages of use, of the second exemplary embodiment of the connection device according to FIG. 6A, in cut-away condition.

On the basis of the FIGS. 6B-D and 7 the build-up of the connection device 101 will now be further gone into. In the condition of FIG. 6A the holes 105*a* and 105*b* are aligned, for the breaking pin 105. In the condition of FIG. 6B the breaking pin is not shown as it has failed.

The said edge 108 forms a stop edge 143 against which a stop edge 142 of the plate 102 may abut in the folded condition of FIG. 6A.

In addition a stop 110 is attached on the plate 103*a*.

On the plate 102 a release/opening mechanism for the hook-shaped confinement member 115 is arranged. On the hinge pin 107 a cam disk 111 is rotatably arranged, which is provided with a cam 112 for cooperation with stop 110, a cam 120, which by means of a rod with hinge ends 126 is movably connected to an end 127 of the confinement member 115, and a cam 121, on which a rotatably attached rod 123 is rotatably attached, which at the end 124 is attached to the plate 102 with a breaking pin 128. A tension spring 125 is attached between the rod 123 and a pin 122 that is fixed to plate 102. The end of the tension spring 125 facing away from the pin 122 is provided with a slide 129 that is slidable along the rod 123.

The breaking pin hole 105*a* is arranged in a block 109, that is provided with an edge 144 against which the edge 145 of the confinement member 115 may come into abutment.

The confinement member 115 can hinge about hinge pin 117. The confinement member 115 is provided with an opening that is formed almost semicircular, and oriented rearward and together with a concave edge 131 in block 150 that is fixed to plate 102 is able to clamp the pin 116 in a confining manner.

In the condition shown in FIG. 6B the rotation position of the cam disk 111 is locked by means of the rod 123 and the breaking pin 128.

In the condition in FIG. 6B the condition of FIG. 5B is almost reached. In the condition in FIG. 6A, the plate 102 is turned in to a maximum extent within the plates 103*a,b*. Said condition is locked by means of breaking pins 105.

Figure 6C:
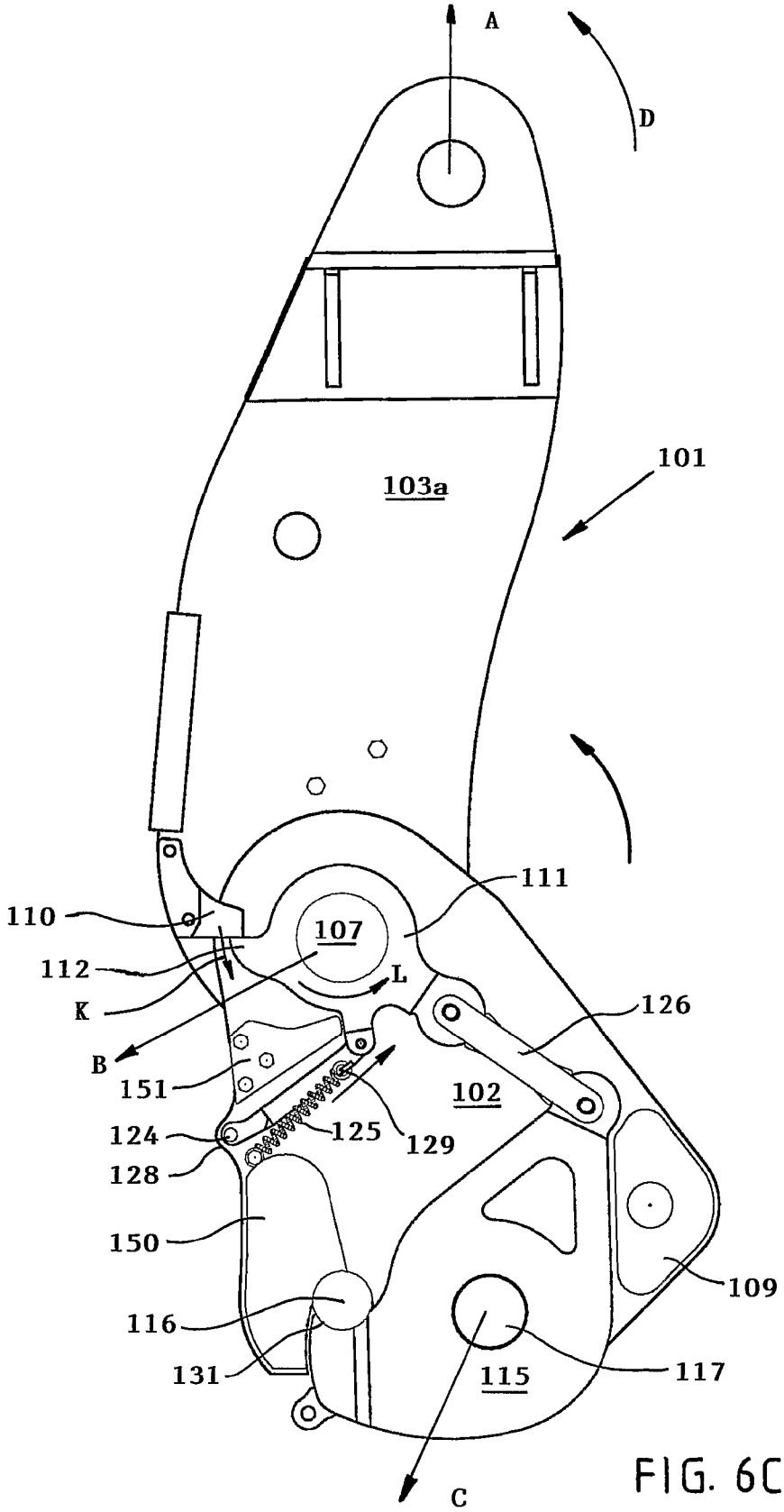

When during pulling in an anchor while using the connection device 101*a* certain tensile force in the anchor line is achieved, the breaking pin 105 will break, as was the case with the exemplary embodiment discussed above. The plates 103*a,b* and the plate 102 will then rotate with respect to each other, as indicated in FIGS. 6B-D.

If it is desired that the front wires to the fluke are detached from the connection device 101, just as described in the previous example, the angle between plates 103*a,b* and the plates 102 can be (further) increased by further swinging of the anchor line in the direction D. After swinging (additionally) over for instance 100 the stop 110 will abut the cam 112. This condition is shown in FIG. 6C. In case of further swinging the plates 103*a, b* the stop 110 will exert a force in the direction K on the cam 112, as a result of which the cam disk 111 is urged in the direction L. The cam 121 will then exert a tensile force on the rod 123, until a predetermined force on the second breaking pin 128 is exceeded. Said force may for instance be 10 tons. Because of said breaking pin 128 an inadvertent activation of the release of the front wires may be prevented.

After the rod 123 has thus been made mobile, the cam disk 111 is able to rotate further, urged by the stop 110 which moves further in the direction K by the further swinging of the plates 103*a,b*. In that way the cam 120 is also moved along, as a result of which a force is exerted in direction L on portion 127 of confinement member 115 via the rod with hinge ends 126. As a result the confinement member 115 will rotate in direction M, whereby its end gives way in the direction N and the pin 116 comes out of clamping and is able to exit in the direction H. This is shown in FIG. 6D.

Figure 6D:
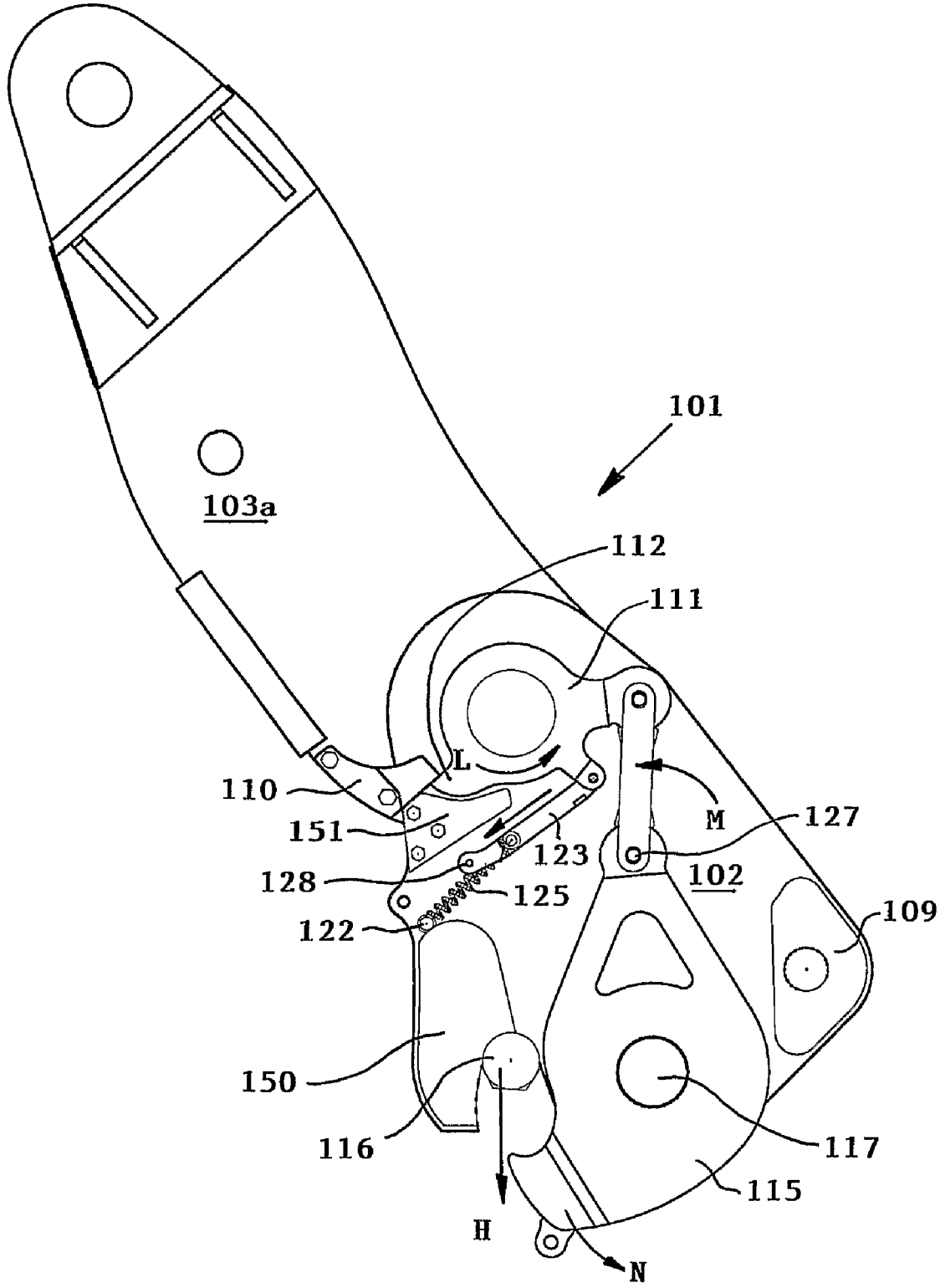
Figure 7:
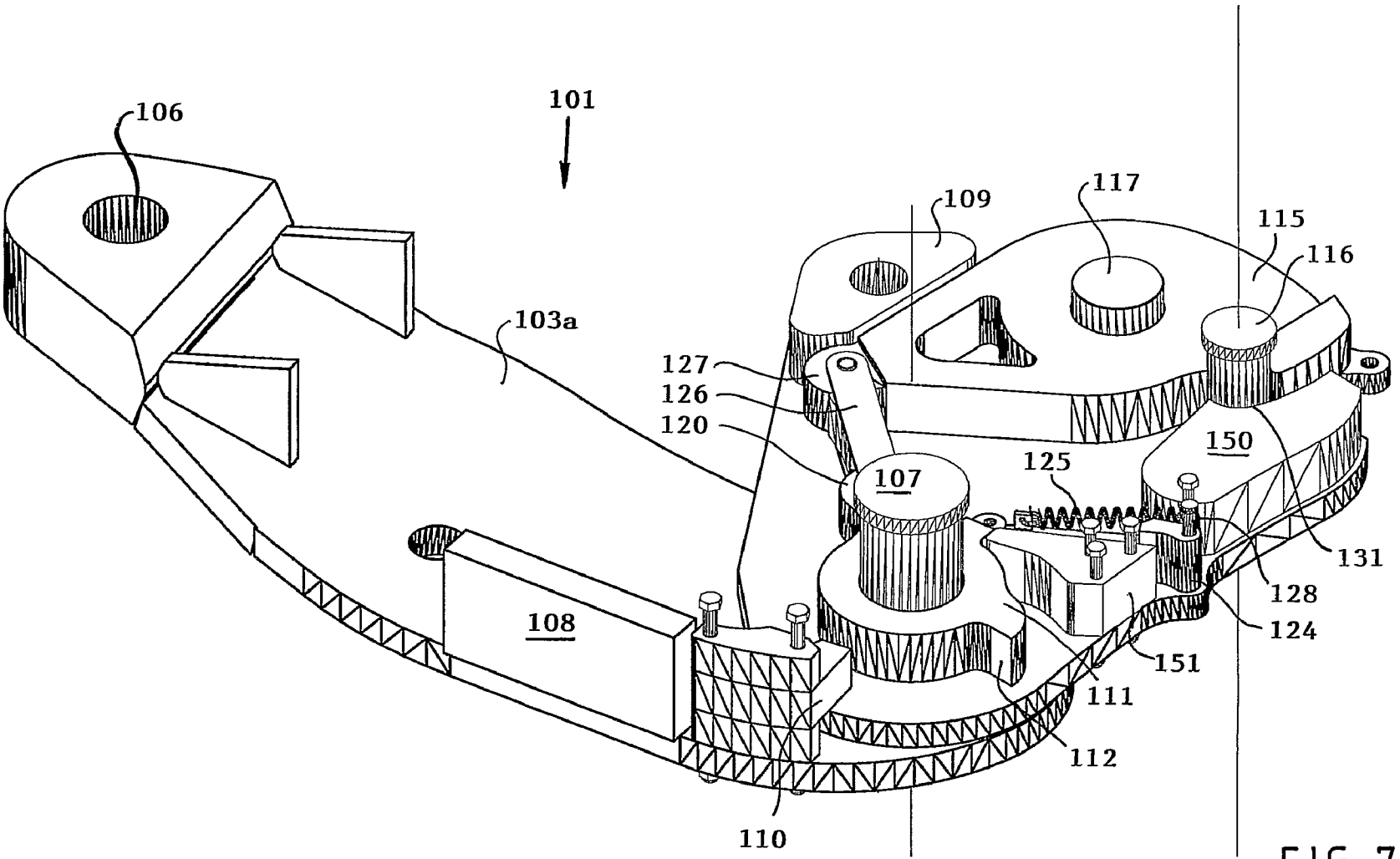
FIG. 7 shows the second exemplary embodiment of the connection device according to the invention, in perspective in the condition of FIG. 6B.

It is also shown in FIG. 6D that the maximum rotary position of the plates 103*a, b* with respect to plate 102 is reached in that way, by abutment of stop 110 against block 151 that is fixed to plate 102. The cam 112 is also stopped from rotating further by block 151. The slide at the end of the tension spring 125 is then displaced along the rod 123 up to an end stop thereon. Due to the connection of the tension spring 125 to the rod 123 it is among others prevented that after failure of the breaking pin 128 it deflects and might hinder other parts in their movement.

In order to use the connection device 101 again after pulling in the anchor, plates 103*a,b* and 102 are turned in again, and a new breaking pin 105 is placed. Subsequently a pin 116 of front fluke-anchor line connection wires is arranged at the location in plate 102, after which means counter the direction N. The rod with hinge ends 126 then swings back, and thus the cam disk 111 is also rotated back again. Due to the spring 125 the rod 123 will be guided to a position near hole 124, after which a new breaking pin 128 can be placed for locking the position of the cam disk 111 and thus the hook 115.

As long as, due to the breaking pin 105, the plates 103*a,b* and 102 are in their folded position, shown in FIG. 6A, the attachment of pin 116 is not loaded by the release mechanism.

It is remarked that where in this application first and second attachment means are referred to, first and second attachment can also be read.

It is remarked that where in this application means for keeping the confinement member in the second position are referred to, retainer for keeping the confinement member in the second position can also be read.

It is furthermore remarked that where in this application means for altering the relative position of the first and second attachment means are referred to, displacement device for altering the relative position of the first and second attachments can also be read.

The invention claimed is:

1. Device for connecting an anchor line to an anchor, the anchor has a fluke and according to a direction of penetration can penetrate into an anchoring ground by exerting a tensile force on the anchor line, wherein the device is provided with an attachment for attachment of the anchor line to the device and at least two attachments for attachment of two fluke-anchor line connection elements which at locations that are spaced apart in a forward direction of penetration are attached to the fluke, wherein at least one of the attachments is adapted for release by swinging the anchor line with respect to the device and wherein the at least one attachment by said swinging of the anchor line is movable between a first position in which a first of the fluke-anchor line connection elements is attached to the device and a second position in which the first fluke-anchor line connection element can release from the device.

2. Device according to claim 1, wherein the at least one attachment is adapted for release by swinging the anchor line in a plane containing the direction of penetration and the two attachments, particularly by (with respect to the direction of penetration) rearward swinging of the anchor line.

3. Device according to claim 1, wherein the at least one attachment is adapted for release of a, considered in direction of penetration, front fluke-anchor line connection element.

4. Device according to claim 1, wherein the at least one attachment comprises a confinement member which is movable from the first to the second position by rotation with respect to the device in response to the swinging of the anchor line.

5. Device according to claim 4, wherein the confinement member comprises a hook, which in the attaching condition engages about the upper end of the fluke-anchor line connection elements in question and is rotatably arranged on the device.

6. Device according to claim 4, further provided with a retainer for keeping the confinement member in the second position.

7. Device according to claim 1, wherein the device is provided with a first and a second attachment for front and rear fluke-anchor line connection elements, respectively, which first and second attachment are spaced apart, wherein, considered in side view, the device with the fluke-anchor line connection elements and the fluke forms a quadrangle with four corner hinges.

8. Device according to claim 7, wherein the device is provided with an adjuster for altering the relative position of the first and second attachment, particularly by rotation of the device in a plane perpendicular to the fluke and containing the direction of penetration.

9. Device according to claim 8, wherein the device is designed as an angle adjuster of the angle between the assembly of fluke-anchor line connection elements and the fluke, and comprises a first part and a second part, which have been provided with the attachment for the anchor line and the first and/or the second attachment, respectively, wherein the first and the second part are connected to each other by means of a hinge and a spaced apart releasable connection, which releasable connection is adapted for failure when exceeding a certain tensile force in the anchor line for allowing the first part and second part to rotate away from each other.

10. Device according to claim 9, wherein the second part comprises at least the first attachment and the hinge is situated rearward from the releasable connection.

11. Device according to claim 9, wherein the angle adjuster is adapted for after release, by increasing the mutual angle between the first and the second part adjusting the angle between the assembly of fluke-anchor line connection elements and the fluke to a first angle of almost 90 degrees.

12. Device according to claim 11, wherein the releasable connection is adapted for release by rearward swinging of the anchor line.

13. Device according to claim 11, wherein the second angle necessary for release of at least one of the attachments extends beyond the first angle.

14. Device according to claim 13, wherein the second angle is situated at 5 degrees or more, preferably at 20 degrees or more beyond the first angle.

15. Device according to claim 11, wherein the device is adapted for after further increase of the mutual angle between the first and the second part releasing the said attachment.

16. Device according to claim 15, wherein the device is adapted for releasing the said attachment not until an intermediate angle between the first and the second part has been further passed through.

17. Device according to claim 16, wherein the intermediate angle is at 5 degrees or more, preferably at 20 degrees or more.

18. Device according to claim 9, wherein the first part and the second part are provided with a cam track and an operation assembly controlled by the cam track, respectively, for the release of the at least one attachment.

19. Device according to claim 9, wherein the first part is provided with a stop, and the second part is provided with a cam, which is part of a movement mechanism for a confinement member for the at least one attachment.

20. Device according to claim 19, wherein the cam is rotatable about the hinge between the first and the second part.

21. Device according to claim 19, wherein the cam is part of a member movable by the stop, which member by means of a movable connection, such as a rod hinging at both ends, is connected to the confinement member.

22. Device according to claim 19, wherein between the cam or the member of which the cam is part and the second part a breaking connection, such as a breaking pin, is arranged.

23. Device according to claim 8, wherein the adjuster is remote controlled.

24. Anchor provided with a device according to claim 1.

25. Anchor according to claim 24, wherein the fluke-anchor line connection elements are bendable, and preferably are formed by wires or chains.

* * * * *